United States Patent [19]

Romanin et al.

[11] Patent Number: 4,854,510

[45] Date of Patent: Aug. 8, 1989

[54] DEVICE AND METHOD FOR STORING AND RETURNING YARN DURING THE WINDING OF CONICAL BOBBINS FED WITH YARN AT CONSTANT SPEED

[75] Inventors: Bruno Romanin, Cordenons; Francesco Ferro; Luigi Colli, both of Pordenone, all of Italy

[73] Assignee: Savio, S.p.A., Pordenone, Italy

[21] Appl. No.: 169,855

[22] Filed: Mar. 18, 1988

[30] Foreign Application Priority Data

Mar. 19, 1987 [IT] Italy ..... 19759 A/87

[51] Int. Cl.[4] ..... B65H 54/42; B65H 59/22; B65H 59/38

[52] U.S. Cl. ..... 242/18 DD; 242/45; 242/150 R; 242/154

[58] Field of Search ..... 242/18 R, 18 DD, 18 CS, 242/45, 147 R, 149, 150 R, 150 M, 154

[56] References Cited

U.S. PATENT DOCUMENTS

| | | | |
|---|---|---|---|
| 2,102,109 | 12/1937 | Brueggemann | 242/45 |
| 3,047,247 | 7/1962 | Kotte | 242/45 |
| 3,231,216 | 1/1966 | Lemarchand | 242/150 R |
| 3,300,161 | 1/1967 | Hermanns | 242/154 |
| 4,019,691 | 4/1977 | Wroclawski et al. | 242/45 |
| 4,120,462 | 10/1978 | Raasch et al. | 242/45 |

FOREIGN PATENT DOCUMENTS

| | | | |
|---|---|---|---|
| 2721972 | 11/1978 | Fed. Rep. of Germany DD | 242/18 |

*Primary Examiner*—Stanley N. Gilreath

*Attorney, Agent, or Firm*—Hedman, Gibson, Costigan & Hoare

[57] ABSTRACT

A device and method for winding conical bobbins with yarn withdrawn at constant speed from individual spinning units, and comprising: a deflecting roller, which moves backwards and forwards by a swinging arm, which compensates for the different speeds at which the yarn is collected on the bobbin under formation wherein yarn is drawn into the storage position and is then released from this storage position, (i.e. returned). This returning operation releases the yarn from its storage position and replaces it (returns it), to its normal feed path; two proximity sensors which defines the range of swing of the yarn storage and return arm; an electronic control unit which receives an electrical signal from the proximity sensors when the arm swings stray outside the regular range to generate, an electrical control signal which activates a pressure variator which varies the pressure on a disc yarn tensioner. This changes the tension on the yarn to return the storage swing to within the regular range. If irregular swing persists, a bidirectional drive is activated to displace the contact between the bobbin and drive roller to restore the storage swing to within the regular range of values.

6 Claims, 1 Drawing Sheet

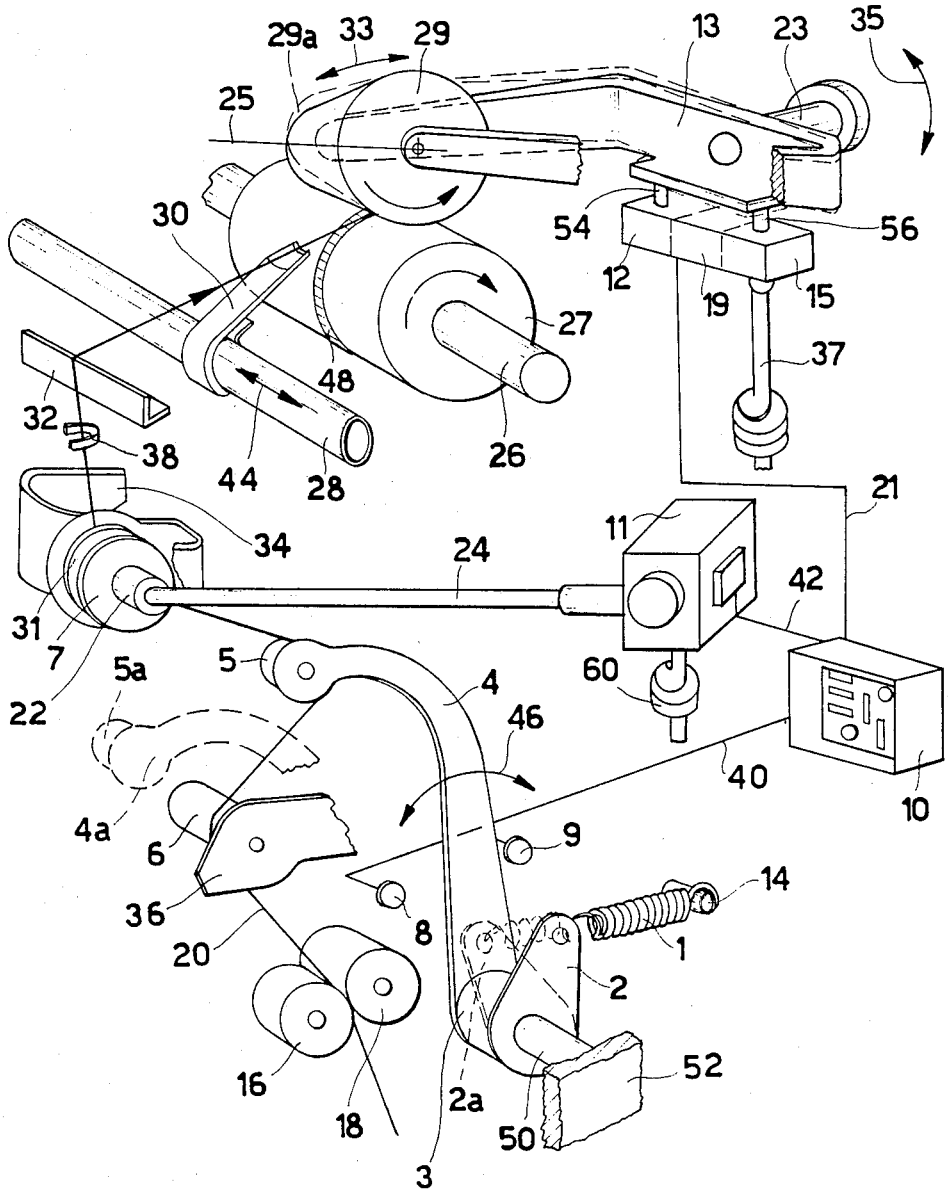
29a
33
29
13
23
35
25
30
54
56
12
19
15
27
37
48
32
38
44
28
26
21
34
11
24
42
31
7
22
5a
5
4
60
46
40
10
4a
6
9
14
36
8
1
20
2
16
52
18
2a
50
3

DEVICE AND METHOD FOR STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units.

In said spinning units, the yarn emerges at their outlet at constant speed from the feed rollers and must be deposited at a speed which varies between the major diameter and minor diameter of the conical bobbin being formed. In such an operational process it is therefore therefore necessary to periodically vary the yarn length in the section between the feed rollers and its point of deposition on the circumference of the conical bobbin.

This length variation and the consequent variation in yarn tension are compensated by adjusting the yarn path by means of a tension regulator and compensator device.

Tension compensators are known in the art. They comprise a deflecting roller connected to a rocker arm. Depending on the instantaneous yarn tension, or rather according to the instantaneous position of the rocker arm, the mobile deflecting roller is deviated to a varying extent from its contract or bearing position, this position being assumed by the action of a force exerted by a counterweight, a spring or similar elastic element. These yarn tension compensators have the drawback of exerting an elastic opposing force which cannot be controlled in respect of the tension variations which can occur in the yarn in the case of non-regular storage.

The conical bobbin under foramtion is driven by a constantly rotating substantially cylindrical drive roller. The dimensions of said bobbin, its taper and angle of the winding helix determine the angular swing amplitude of the mobile arm.

The swing position of this latter, which keeps a roller connected to it constantly adhering to the yarn, represents the yarn storage value, which constantly increases and decreases according to the stage in the progress of the entire yarn storage and return cycle. Any slippage between the control roller and bobbin under formation, which is frequently present due to the friction drive used, increases the length of yarn stored and changes the swing position of the mobile arm which, under the action of the elastic element acting in a pulling capacity, is moved in the limit into an abutting position, consequently nullifying the tensioning of the yarn being collected. Thus without tension, this latter winds with irregular turns, so prejudicing the bobbin formation and in the limit the yarn leaving the feed rollers twists about itself to create loops and tangles such as to compromise the yarn consistency.

The tangled yarn also frequently creates obstacles such as to interrupt yarn continuity, so blocking the spinning process. The high yarn formation rate of spinning units means that any production hold-up in such spinning units assumes considerable importance because of the reduced rate of yarn collection in the form of bobbins.

Yarn tension compensators of this type also have the drawback that if the yarn count or thickness, the type of bobbin under formation or the winding helix angle varies, they have to be adapted to this by onerous manual adjustments to the individual spinning stations, or by replacing the elastic element with another elastic element which conforms to the differnet operating characteristics. These devices are therefore inflexible in use.

Devices for storing and intermittently returning yarn, preferably for textile machines, are also known. These include by way of example the devices described and claimed in the German Pat. Nos. DE 1785153 and DE 1454917.

Such devices have numerous drawbacks; they are insensitive to tension and even less to tension variations in the winding yarn because the storage and return element is of a type which, by means of a lever system, is completely controlled by a to-and-fro drive rod which passes along the entire machine face to operate the yarn stores of all the spinning units. They are unable to adjust the yarn tension to one or more predetermined values preset according to the type of yarn being collected or of the bobbin under formation. They present considerable difficulty in adjusting the value preset for the storage of the yarn being wound, as this adjustment must be made manually by an operator by adjusting the length of the connecting rods or the positions of the lever rotation pivots in order to vary the lever arms, and is therefore lengthy, laborious and variable according to the type of geometrical characteristics of the bobbin under formation and the winding helix angle; they also have a rather high inertia force due to the presence of several lever systems which are mobile simultaneously but intermittently, and tend to trigger uncontrollable vibratory oscillation and at the same time limit the collection rate. They also set limits on the machine length and therefore on the number of spinning units as their operation relies on drive rods which have to extend along the face of the collection units and are subjected to large numbers of to-and-fro movement strokes. These devices are also rather bulky and inefficient when slippage is present between the conical bobbin under formation and the control roller. This slippage, which is more or less accentuated, is often present because the conical bobbin being cross-wound continuously rests against a drive roller which on a determined but narrow part of its surface possesses a friction band for friction drive purposes.

A further drawback of such devices is the presence of mobile members, such as rods or shafts, which have to be provided and mounted at the commencement of machine construction, and cannot be fitted later.

Said mobile members control the operation of several storage devices and extend along the entire winding face from a position at the head of the machine. Because of the principle on which they are constructed, these devices are therefore inflexible and unadaptable to pre-existing spinning stations or stations not provided with the aforesaid mobile members which pass along the front structure of the entire collection face.

An object of the present invention is to obviate the aforesaid drawbacks by providing an intermittent storage and return device wherein yarn is drawn into the storage position and is then released from this storage position (i.e. returned). This returning operation releases the yarn from its storage position and replaces it (returns it), to a normal feed path. This device, winding conical bobbins fed with yarn at constant speed has the following advantages:

enables the stored length to be always maintained within a preset range of values with only limited variations in yarn tension, and with only limited variations in the average winding speed allows the immediate takeup of any additional yarn lengths accidentally present due to slippage between the drive roller and conical bobbin under formation;

does not limit the yarn collection speed in the formation of conical bobbins;

does not set limits on the machine length and thus does not limit the number of winding units to be positioned side by side, as these do not require for their operation any drive member extending along the entire winding face, and therefore do not possess further masses moving longitudinally to the machine and connected to central drive members;

does not limit the diameter of the bobbins obtainable and does not require laborious adjustment to be made when changing the taper of the bobbin under formation;

has extreme operational flexibility such as to allow a range of application which enables soft or compact bobbins to be made up within a range of yarn counts without the need for laborious mechanical adjustments;

can be applied without the need for extensive demounting and remounting of the components parts of the winding machine if this, being already set for forming cylindrical bobbins, is to be converted for forming conical bobbins can be easily disengaged so as to make it possible to form both conical and cylindrical bobbins on the same machine.

A further object of the present invention is to provide a yarn storage and return device which requires very little maintenance. These and further objects are all attained by the yarn storage and return device of the present invention, in particular for textile machines operating to form conical bobbins, characterised by comprising:

a lever system with two suitably shaped and positioned flat elements, and being able to move with swing motion about an axis by means of a bush positioned as a rigid element joining together said flat elements, of which one operates, in union with a deflecting roller, as a yarn storage and return arm and, at the same time, as a tension compensator and regulator element for the yarn being wound, and the other flat element operates as an attachment and connection element for the mobile and eyelet of a helical elastic element subjected to traction, in order to generate an opposing force which balances the force produced by the tension of the yarn being wound;

two proximity sensors or similar elements, positioned to define the regular range of swing of the yarn storage and return arm, and generating an electrical signal or a series of electrical signals when the yarn storage and return swing movements stray outside the predetermined preset regular range;

an electronic control unit, of known type, which receives said electrical signal or said series of electrical signals provided by the proximity sensors and processes them in order to generate an electrical control signal which activates a pressure variator, said control signal subsequently activating a bidirectional drive unit if non-regular storage swing persists;

a pressure variator which increases or decreases to a limited extent, under the influence of said control signal, the pressure on the disc yarn tensioner in order to adjust the tension of the yarn being wound to a value which is slightly higher or slightly lower than the previous value so as to restore the storage swing to within the range of values corresponding to regular storage.

a bidirectional drive unit which, on being activated due to the persistence of non-regular storage swing, inclines the axis of the conical bobbin, so displacing the diameter of effective contact between the bobbin and drive roller to consequently obtain a variation in the average yarn winding speed in order to restore the storage swing to within the range of values corresponding to regular storage. According to one embodiment, the device is present individually in each yarn winding position.

According to a further embodiment, the device has no mechanical link with the yarn guide element or with the bobbin carrier arm, and therefore does not directly follow the degree of fullness of the bobbin itself.

The device according to the invention has the advantage, for any variation in the type of yarn and the type of bobbin under formation, of automatically adjusting and setting the tension of the yarn being collected, to thus obtain regular storage and return swings. Thus, the yarn is drawn into the storage position when the tension is low and subsequently released from this storage position, i.e. returned, when the tension is high. This returning operation releases the yarn from its storage position and replaces it (returns it), to its normal feed path.

The device according to the invention has the further advantage that for any undesired variation in the position of the effective drive diameter it automatically restores the effective drive diameter to a position which results in correct winding of the conical bobbin.

The device according to the invention also has the advantage of ensuring that once adjusted to the value corresponding to regular storage swing, the pressure on the disc yarn tensioner remains constant so as not to minimally vary the tension of the yarn being continuously wound onto the conical bobbin.

A preferred embodiment of the device of the present invention is described hereinafter by way of non-limiting example with reference to the single accompanying FIGURE.

This is a diagrammatic isometric view of the storage and intermittent return device of the present invention cooperating with the yarn guide element, the bobbin under formation being driven by the friction band of the drive roller, the FIGURE showing the moment of maximum storage in the yarn travel while the yarn guide element is moving in the increasing diameter direction of the cross-wound package.

In the single FIGURE, the reference numeral 1 indicates the helical elastic element which is subjected to traction to generate an opposing force for balancing the force produced by the tension in the yarn being wound; 2 is the mobile flat element which acts as an attachment and connection element for the eyelet of the helical elastic element 1; *2a* is the position which the flat element 2 assumes at that moment during its swing movement when the stored length of yarn 20 is zero or a minimum; 3 is the bush or ring which rigidly joins together the two flat elements 4 and 2 of the yarn storage and return lever system; 4 is the flat element which in union with a deflecting roller 5 acts as the storage and return arm for the yarn 20 while also acting as the tension compensation and adjustment element for the yarn 20 being wound; 4a is the position which the mobile flat element 4 assumes at that moment during its swing movement when the stored length of yarn 20 is zero or a minimum; 5 is a deflecting roller or similar element which acts as a mobile yarn guide with swing movement in the storage and return of the yarn 20. It is rigid with the end of the mobile flat element 4 but is able to rotate about itself so as not to generate grazing friction against the yarn 20 undergoing continuous collection. It has a substantially cylindrical profile; 5*a* is the position which the mobile yarn deflecting and guide roller 5 assumes at that moment during its swing movement when the stored length of yarn 20 is zero or a minimum; 6 is a fixed yarn deflection and guide roller having a substantially cylindrical profile and connected rigidly to the base plate 36 but free to rotate about itself to not generate grazing friction against the yarn 20 undergoing continuous collection movement; 7 is a yarn tensioner disc or washer able both to rotate idly about its axis of rotation and to translate axially. Said disc compresses the yarn and thus tensions it by the effect of the force exerted by a piston operated by the pressure of a fluid; 8 is a proximity sensor or similar element positioned to define the minimum storage end of the regular range of swing of the yarn storage and return arm 4; 9 is a proximity sensor or similar element positioned to define the end corresponding to maximum storage; 10 is an electronic control unit of known type which receives the electrical signals provided by the proximity sensors 8 and 9 in order to generate a control signal which activates the pressure variator 11; 11 is a pressure variator which increases or reduces the pressure on the disc yarn tensioner; 27 is the drive roller for rotating the conical bobbin 29 under formation; 13 is the bobbin carrier arm supporting the yarn bobbin 29 as its diameter gradually increases; 14 is the connection pin for connection to the fixed eyelet of the helical elastic element 1; 31 is a yarn tensioner disc or washer arranged to rotate idly about a fixed axis of rotation but not necessarily susceptible to axial movement, it facing the disc 7; 16 and 18 indicate a pair of rollers positioned along the path of the yarn 20, both rollers being pressed against each other with said yarn 20 passing between them to withdraw it from a spinning unit of a rotor spinning machine and feed it from its outlet towards the compensator device of the present invention at constant speed; 29 is the cross-wound conical bobbin under formation; 20 is the collected yarn subjected to storage and return at the outlet of the pair of feed rollers 16 and 18; 22 is the actuator member which provides the compression thrust on the disc 31 in order to subject the yarn being wound to a tension which is appropriate for obtaining storage and return swing movements lying within the range of values corresponding to regular storage, as defined by the proximity sensors 8 and 9; 24 is the pressurised fluid pipe which connects the actuator member 22 to the pressure variator 11; 26 is the drive shaft which extends along the entire winding face; 28 is a hollow or solid shaft of circular cross-section which is operated as a control rod for the yarn guide elements 30 by means of a suitably shaped cam for transmitting motion of appropriate kinematic and dynamic characteristics to said yarn guide element 30; 30 is the yarn guide element driven with reciprocating to-and-fro motion by the drive shaft or rod 28 which extends along the entire operational winding face; 32 is a blade for deflecting the path of the yarn 20 and can be linear or shaped with more or less accentuated profiles already known to the art, 34 is the disc yarn tensioner support, connected to the structure of the winding unit, not shown in the FIGURE; 36 is the base plate for the roller 6, fixed to the machine structure, not shown in the FIGURE; 38 is a fixed element for guiding the yarn 20 in its movement of collection onto the package 19; 40 is the connection cable between the proximity sensors 8 and 9 and the electronic control unit 10; 42 is the connection cable between the electronic control unit 10 and the pressure variator 11; 44 indicates the reciprocating to-and-fro movement path of the shaft 28; 46 represents the swing path of the mobile flat element 4; 48 is the friction region in the form of a narrow band for driving a conical bobbin by the drive roller 27; 50 is a shaft or pivot about which the intermittent storage and return lever system for the yarn 20 swings on the bush coupling 3; 52 is the base plate which supports the pivot 50 and is fixed to the machine structure; 60 is the passage pipe for the operating fluid required for operating the actuator member 22 which generates the thrust for tensioning the yarn 20 being wound; 37 is the passage pipe for the operator fluid required for operating the actuators 12 and 15; 12 is an actuator cylinder; 19 is a servovalve or solenoid valve for controlling the direction of the flow of the operating fluid which provides the power necessary for operating the actuator cylinders 12 and 15; 15 is an actuator cylinder; 21 is the connection cable between the electronic control unit and the electrical actuaor of the servovalve 19; 23 is the pivot about which the bobbin carrier arm rotates by the effect of the movement of the pistons 54 or 56 represented by the rods of the actuator cylinders 12 or 15; 15 is a line representing the axis of rotation of the conical bobbin 29; 33 is a line representing the displacement of the inclination of the axis of rotation of the conical bobbin 29 to the substantially vertical plane containing the axis of rotation of the roller 27; 35 is a line representing the angular rotation in both directions of the pivot 23; 54 is the rod of the actuator cylinder 12; 56 is the rod of the actuator cylinder 15.

The operation of the device according to the invention is as follows.

The purpose of the device according to the invention is to adapt the varying winding speed deriving from the taper of the bobbin 29 to the constant outlet speed from the feed rollers 16 and 18. The average winding speed must correspond substantially to the speed of extraction of the yarn from the spinning unit. When the yarn 20 is being collected on the minor diameter of the bobbin 29 the winding speed is less than the feed speed from the extracting rollers 16 and 18, and the lever system by measn of its mobile flat element 4 stores a suitable length of yarn 20. This stored length is returned gradually as the collection speed increases on moving the yarn towards the major diameter of the bobbin 29 by means of the yarn guide element 30.

The ratio of the minor diameter to the major diameter of the bobbin 29 under formation determines the maximum length of yarn which has to be stored and then returned for each complete transverse cycle of the yarn guide element 30. As said ratio decreases continuously with increasing fullness of the bobbin 29 under formation, the amplitude of the swing movement of the mobile yarn deflecting and guide roller 5 also decreases for decreasing storage of yarn 20.

The mobile deflecting roller 5 generates a loop by deflecting the yarn 20 from its path. This loop therefore has a continuously varying amplitude and the device of the present invention is automatically controlled in accordance with this variation, to act as a compensator for the periodic tension variations which arise as a result of the periodic winding speed variations in the formation of a conical bobbin.

In order to compensate said tension variations to which the collected yarn 20 is subjected and level them out to a substantially constant value, the mobile deflecting roller 5 has to assume different positions relative to the fixed deflecting roller 6. Because of the rigid connection, this variation in the position of the mobile deflecting roller 5 also corresponds to the swing of the two flat elements 4 and 2. The flat element 2 acts as the attachment and connection element for the end eyelet of a helical elastic element 1 which, urged by traction, generates a return force such as to oppose the force produced by the tension in the yarn being wound.

Because of the rigid connection between the two flat elements 4 and 2 provided by connection bush 3, said opposing action produces balance at the storage roller 5 at every moment between the elastic return force and the force produced by the tension in the yarn 20 being wound.

The effect of the periodic variation in the winding speed of the yarn 20 on the conical bobbin 29 is a variation in the yarn tension. This latter tension variation is stabilised about the average value of the elastic return force of the elastic element 1 which is subjected to oscillating deformation between two positions to which the swing positions of the flat element 4 and storage roller 5 perfectly correspond.

If during the continuous winding process the storage and return swings remain within the predetermined limits set by the positioning of the two proximity sensors 8 and 9, said sensors do not generate any electrical signal and the electronic control unit 10 remains deactivated while the storage and return cycles of the yarn 20 remain regular. Thus no activation signal for the pressure variator 11 is generated at the output of the electronic control unit 10, and is therefore not fed. If during the continuous winding process the storage and return swings stray outside the predetermined limits set by the positioning of the two proximity sensors 8 and 9, said sensor generate an electrical signal or a series of electrical signals, and these are fed through the connection cable 40 and received by the electronic control unit 10.

On receipt of said electrical signals this latter instantaneously provides at its output an electrical control signal which activates the pressure variator 11. Under the action of said control signal, the pressuer variator 11 increases or decreases the pressure on the yarn tensioner discs 7 and 31 through the connection pipe 24, in order to adjust the tension of the yarn being wound to a value slightly higher or lower than the previous value. The storage and return swing motion is therefore rapidly restored to within the range of values corresponding to regular storage as defined by the proximity sensors 8 and 9.

This latter operation can be further clarified as follows. If the mobile deflecting roller 5 causes the loop in the yarn 20 to assume a position which exceeds the maximum storage limit allowed by the position of the contact sensor 9, which defines one end of the regular range, said sensor 9, because the flat element 4 is present in front of it, generates an electrical signal or a series of electrical signals which are fed through the connection cable 40 to the electronic control unit 10.

This latter, after identifying the type of electrical signal received from the proximity sensor 9, correspondingly produces at its output a specific electrical control signal, which is fed through the connection cable 42 to activate the pressure variator 11, which reduces the pressure of the operating fluid and therefore, by way of the connection pipe 24 and actuator member 22, reduces the pressure on the yarn tensionser discs 7 and 31. Consequently the tension of the yarn 20 being wound settles at an average value which is slightly less than the previous average value.

By reducing only slightly the average tension of the yarn 20 being wound, the yarn slackens and becomes less embedded into the already deposited layers of yarn, and continues its winding in the form of turns of slightly increased diameter.

Such turns result in rapid and progressive takeup of the excessive storage created by a multiplicity of factors.

If the mobile deflecting roller 5 causes the loop in the yarn 20 to assume a position which lies below the minimum storage limit allowed by the position of the contact sensor 8, which defines one end of the regular range, said sensor 8, becuase the flat element 4 is present in front of it, generates an electrical signal or a series of electrical signals which are fed through the connection cable 40 to the electronic control unit 10. This latter, after identifying the type of electrical signal received from the proximity sensor 8, correspondingly produces at its output a specific electrical control signal, which is fed through the connection cable 42 to activate the pressure variator 11, which rapidly increases the pressure of the operating fluid and thus, by way of the connection pipe 24 and actuator member 22, increases the pressure on the yarn tensioner discs 7 and 31. Consequently the tension of the yarn 20 being wound settles at an average value which is slightly greater than the previous average value. By increasing only slightly the average tension of the yarn 20 being wound, the yarn tightens and becomes more embedded into the already deposited layers of yarn, and continues its winding in the form of turns of slightly decreased diameter. These turns rapidly and progressively cause the yarn to be stored in a progressively increasing loop, and the intermittent swing of the mobile flat element 4 is restored to within the limits of the predetermined regular range set by the positions of the sensors 8 and 9.

It is well known that the yarn tension can only be allowed to fluctuate within a fairly narrow range. On the one hand, the yarn tension must not assume such values as to compromise the integrity and elasticity of the yarn itself, and on the other hand must not fall below values which allow the formation of twists or knots or similar entanglement defects. The yarn tensioner must obviously operate within the range of regular tension values, ie those which do not lead to the aforementioned drawbacks.

As is apparent from the aforesaid, the action of the yarn tensioner may be insufficient or only partly sufficient to restore the intermittent swing to within the regular range defined by the proximity sensors 8 and 9. To ensure that even in such cases regular swing motion is restored, a drive unit is operated after a sufficiently short time in order to incline the axis of the conical bobbin 29 so as to vary the average winding speed. In this respect, if non-regular storage swings still persist immediately after the yarn tensioner has reached the limit of its action, the electronic control unit immediately produces an output electrical control signal which activates the bidirectional drive unit through the servovalve 19 which actuates and conveniently controls one of the two actuator cylinders 12 or 15.

The corresponding rod, functioning as a lifting piston, transmits an angular rotation to the bobbin carrier arm 13 to incline the axis of rotation of the conical bobbin in one direction or the other, and consequently displace the diameter of effective contact between the bobbin 29 and drive roller to obtain a suitable variation in the average winding speed of the yarn 20 in order to restore the storage swing to within the range of values corresponding to regular storage.

This latter operation can be further clarified as follows. If the mobile deflecting roller 5 causes the loop in the yarn 20 to continue to assume a position which exceeds the maximum storage limit allowed by the position of the contact sensor 9, which defines one end of the regular range for maximum storage, said sensor 9, because the flat element 4 is present in front of it, generates an electrical signal or a series of electrical signals which are fed through the connection cable 40 to the electronic control unit 10.

This latter, after identifying the type of electrical signal received from the proximity sensor 9, correspondingly produces at its output a specific electrical control signal, which is fed through the connection cable 21 to activate the servovalve 19 of the bidirectional drive unit. Said valve 19 opens and controls the direction of flow of operating fluid, to activate the actuator cylinder 15 which urges the rod 56 outwards and upwards.

This latter transmits an angular anticlockwise rotation to the bobbin carrier arm 13, which consequently displaces the diameter or band of effective contact between the bobbin 29 and the drive roller 27 in the decreasing diameter direction, ie a contact displacement towards the minor base of the bobbin.

Thus the average winding speed increases, ie settles at an average value which is slightly higher than the previous average value, so causing rapid and progressive takeup of the excessive storage created by a multiplicity of factors.

As the layer of yarn present on the conical base tube on which the yarn continues to wind is sufficiently soft and therefore deformable, this displacement of the contact diameter or band takes place gradually. If the mobile deflecting roller 5 causes the loop in the yarn 20 to continue to assume a position which lies below the minimum storage limit allowed by the position of the contact sensor 8, said sensor 8, because the flat element 4 is present in front of it, generates an electrical signal or a series of electrical signals which are fed through the connection cable 40 to the electronic control unit 10.

This latter, after identifying the type of electrical signal received from the proximity sensor 8, correspondingly produces at its output a specific electrical control signal, which is fed through the connection cable 22 to activate the servovalve 19 of the bidirectional drive unit. Said valve 19 releases and controls the direction of flow of the operating fluid, to activate the actuator cylinder 12 which urges the rod 54 outwards and upwards. This latter, acting as a lifting piston, transmits an angular clockwise rotation to the bobbin carrier arm 13, which consequently displaces the diameter or band of effective contact between the bobbin 29 and the drive roller 27 in the increasing diameter direction, ie in the direction of the major base of the bobbin. This latter displacement is indicated by the line 29a which shows the new position assumed by the conical bobbin 29. Thus the average winding speed decreases, ie settles at an average value which is slightly lower than the previous average value, so resulting in rapid and progressive yarn storage within a continuously increasing loop, and the swing of the mobile flat element returns to within the predetermined range set by the position of the sensors 8 and 9.

The width of said regularity range is predetermined and preset by the geometrical characteristics of the winding being made and the characteristics of the yarn and conical bobbin 29 under formation. It has been found that the device for intermittently storing and returning yarn during the winding of conical bobbins fed with yarn at constant speed, according to the present invention, operates very reliably and periodically compensates the variations in yarn tension without the mobile deflecting roller 5 undergoing uncontrollable swing.

The use of the device according to the invention is not limited to the winding of conical bobbins produced on spinning units, but can also be advantageously applied to the winding of conical bobbins on any winding unit.

A preferred embodiment has been described herein but it is apparent that other embodiments are possible which fall within the scope of the present invention.

Thus the positions of the operating lever systems can vary; different drive arrangements can be provided; it is also possible to vary the shapes and dimensions of the mobile yarn deflecting roller 5 and fixed deflecting roller 6 together with the two flat elements 4 and 2 which undergo swing movement; ratios and dimensions of the various operational elements can also vary such as the rods 54 and 56 of the actuators 12 and 15 and the elastic element 1; modifications of a practical applicational nature can be made, thus for example the position of the storage lever system can be sensed by an optical rod, or by one or more optical sensors in cooperation with bar codes; this latter position, which is converted into an electrical signal and processed as heretofore described, can also be sensed on a circumferential arc close to or in correspondence with the axis of rotation of the storage lever system or at the ends of the swing movement. Obviously the various processed signals can be functions of other physical quantities related to the aforesaid, in that the arrangement of the various units of the device can be easily modified according to the various types of quantities to be processed or compared. Numerous modifications can be made to the present invention thus conceived, all of which fall within the scope of the inventive concept. Moreover, all details can be replaced by other technically equivalent elements. In practice the materials used and the conformations can be chosen according to requirements; all without leaving the scope of the inventive idea as claimed hereinafter.

We claim:

1. A yarn storage and return device for yarn being wound on a conical bobbin driven at a constant speed by drive means in contact therewith, comprising:

(a) a lever system including a shaft, an elastic element, and a pair of arms, which are connected to and move with each other through which said shaft passes, and which can swing around the axis defined by said shaft, one of said arms having a deflecting roller and acting as a yarn storage and return means and a tension compensator and a regulator for the wound yarn, and the other of said arms being connected to said elastic element for generating a balancing counterforce to the tension of said wound yarn;

(b) sensing means for sensing the position of said storage and return arm which define a predetermined preset swing range of said yarn storage and return arm for generating one or more electrical signals when the range of swing of said storage and return arm deviates from said preset range;

(c) an electronic control processor unit for receiving and processing said electric signal from said sensing means for generating a control signal;

(d) a disc yarn tensioner for adjusting the tension of the yarn being wound;

(e) a pressure variator operatively connected to said disc yarn tensioner for increasing or decreasing the pressure on said disc yarn tensioner for restoring the range of swing of said storage arm to within the preset range defined by said positional sensors; and (f) a bidirectional drive unit responsive to said sensing means for displacing the contact between the bobbin and its drive means by inclining the axis of the bobbin for obtaining a variation in the average yarn winding speed for restoring the swing of said storage and return arm within its preset range.

2. The device of claim 1, wherein the elastic element is helical.

3. The device of claim 1, wherein the bidirectional drive unit is a stepping motor.

4. The device of claim 1, wherein the bidirectional drive is a double piston actuator, activated by a valve means for regulating the direction of operating fluid, controlled by the control signal of said electronic control processor unit.

5. In an apparatus for winding yarn on a conical bobbin driven at constant speed by drive means in contact therewith, including a guide for guiding the yarn onto the bobbin and a support for supporting the bobbin, a device for storing and returning yarn being wound on the bobbin independent of said guide and said support, wherein the device comprises:

(a) a lever system including a shaft, an elastic element, and a pair of spaced apart arms which are rigidly joined by a bushing, through which said shaft passes, and which can swing around the axis defined by said shaft, one of said arms having a deflecting roller and acting as a yarn storage and return means and a tension compensator and a regulator for the wound yarn, and the other of said arms being connected to said elastic element for generating a balancing counterforce to the tension of said wound yarn;

(b) sensing means for sensing the position of said storage and return arm which define a predetermined preset swing range of said yarn storage and return arm for generating one or more electrical signals when the range of swing of said storage and return arm deviates from said preset range;

(c) an electronic control processor unit for receiving and processing said electric signal from said sensing means for generating a control signal;

(d) a disc yarn tensioner for adjusting the tension of the yarn being wound;

(e) a pressure variator operatively connected to said disc yarn tensioner for increasing or decreasing the pressure on said disc yarn tensioner for restoring the range of swing of said storage arm to within the preset range defined by said positional sensors; and (f) a bidirectional drive unit responsive to said sensing means for displacing the contact between the bobbin and its drive means by inclining the axis of the bobbin for obtaining a variation in the average yarn winding speed for restoring the swing of said storage and return arm within its preset range.

6. A method for storing and returning yarn being wound on a conical bobbin driven at a constant speed by drive means in contact therewith, comprising:

(a) driving a lever system means having a storage and return arm means for storing and returning yarn, for generating a balancing counterforce to the tension of said wound yarn;

(b) sensing the position of said storage and return arm means of said lever system for defining a predetermined preset swing range of said arm for generating one or more electrical signals when the range of swing of said arm deviates from said preset range by one or more position sensing means;

(c) receiving and processing said electrical signal from said sensing means and generating a control signal by an electronic control processor unit;

(d) adjusting the tension of the yarn being wound by a disc yarn tensioner means;

(e) increasing or decreasing the pressure on said disc yarn tensioner means for restoring the range of swing of said storage and return arm to within the preset range defined by said positional sensor means by a pressure variation means; and (f) displacing the contact diameter between the bobbin and its drive means by inclining the axis of the bobbin for obtaining a variation in the average yarn winding speed for restoring the swing of said storage arm to within its preset range.

* * * * *